US011600215B2

(12) United States Patent
Lin

(10) Patent No.: US 11,600,215 B2
(45) Date of Patent: Mar. 7, 2023

(54) IMAGE ADJUSTING METHOD OF DISPLAY APPARATUS AND APPLICATIONS THEREOF

(71) Applicant: BENQ CORPORATION, Taipei (TW)

(72) Inventor: Hsin-Nan Lin, New Taipei (TW)

(73) Assignee: BenQ Corporation, Taipei (TW)

( * ) Notice: Subject to any disclaimer, the term of this patent is extended or adjusted under 35 U.S.C. 154(b) by 0 days.

(21) Appl. No.: 17/482,545

(22) Filed: Sep. 23, 2021

(65) Prior Publication Data

US 2022/0114973 A1 Apr. 14, 2022

(30) Foreign Application Priority Data

Oct. 13, 2020 (CN) ..... 202011089488.1

(51) Int. Cl.

*G09G 3/34* (2006.01)
*G09G 5/10* (2006.01)
*G09G 3/20* (2006.01)

(52) U.S. Cl.

CPC ..... *G09G 3/2007* (2013.01); *G09G 5/10* (2013.01); *G09G 2320/066* (2013.01); *G09G 2320/0626* (2013.01); *G09G 2320/0673* (2013.01); *G09G 2360/144* (2013.01)

(58) Field of Classification Search

CPC ..... G09G 2320/0626–0653; G09G 2360/144; G09G 2320/0673

See application file for complete search history.

(56) References Cited

U.S. PATENT DOCUMENTS

| | | | | |
|---|---|---|---|---|
| 8,120,570 | B2 | 2/2012 | Kerofsky | |
| 9,355,588 | B2 * | 5/2016 | Mahowald | G09G 3/3413 |
| 9,513,739 | B2 | 12/2016 | Herz et al. | |
| 9,530,342 | B2 * | 12/2016 | Bell | G09G 3/007 |
| 9,622,326 | B1 * | 4/2017 | Devyver | G09G 3/3406 |
| 10,204,539 | B2 * | 2/2019 | Bell | G09G 3/2003 |
| 10,475,363 | B2 * | 11/2019 | Chen | G09G 3/3413 |

(Continued)

FOREIGN PATENT DOCUMENTS

CN 104778938 A 7/2015

OTHER PUBLICATIONS

Search report of counterpart application by EPO dated Feb. 14, 2022.

*Primary Examiner* — Patrick F Marinelli

(57) ABSTRACT

An image adjusting method of a display apparatus includes steps as follows: A plurality of preset grayscale-brightness relationship curves are determined corresponding to a plurality of time periods of a day, respectively. A reference grayscale-brightness relationship curve is selected from the preset grayscale-brightness relationship curves according to an acquisition time of an image data, corresponding to one of the time periods. A real-time ambient light is acquired, and it is compared with at least one of a reference contrast and a reference ambient light brightness corresponding to the reference grayscale-brightness relationship curve. At least one other grayscale-brightness relationship curve is selected from the preset grayscale-brightness relationship curves according to a comparison result to at least partially replace the reference grayscale-brightness relationship curve for adjusting the image data. The adjusted image data is then displayed.

18 Claims, 7 Drawing Sheets

(56) References Cited

U.S. PATENT DOCUMENTS

| | | | | |
|---|---|---|---|---|
| 10,546,524 | B2 * | 1/2020 | Bell | G09G 3/2003 |
| 10,600,386 | B2 * | 3/2020 | Liu | G09G 3/2003 |
| 10,872,583 | B2 * | 12/2020 | Wang | G06F 3/0484 |
| 11,227,533 | B2 * | 1/2022 | Liu | G09G 3/2092 |
| 11,289,053 | B2 * | 3/2022 | Lou | G09G 3/20 |
| 2008/0303918 | A1 * | 12/2008 | Keithley | G09G 3/20 348/223.1 |
| 2015/0029168 | A1 * | 1/2015 | Mahowald | G09G 3/3413 345/207 |
| 2015/0070337 | A1 * | 3/2015 | Bell | G09G 3/2003 345/82 |
| 2017/0076653 | A1 * | 3/2017 | Bell | G09G 3/007 |
| 2017/0213523 | A1 * | 7/2017 | Liu | G09G 3/3406 |
| 2019/0172382 | A1 * | 6/2019 | Bell | G09G 3/007 |
| 2021/0234114 | A1 * | 7/2021 | Li | H01L 27/326 |
| 2021/0319735 | A1 * | 10/2021 | Hong | G09G 3/20 |
| 2022/0114973 | A1 * | 4/2022 | Lin | G09G 5/10 |

* cited by examiner

IMAGE ADJUSTING METHOD OF DISPLAY APPARATUS AND APPLICATIONS THEREOF

This application claims the benefit of People's Republic of China application Serial No. 202011089488.1, filed Oct. 13, 2020, the subject matter of which is incorporated herein by reference.

BACKGROUND OF THE DISCLOSURE

Field of the Disclosure

The disclosure relates in general to an adjusting method of a display apparatus and applications thereof, and more particularly to an image adjusting method of a display apparatus and applications thereof.

Description of the Related Art

With the increasing popularity of electronic products, such as smart phones, tablet computers, notebook computers, personal digital assistants (PDA) and other portable electronic devices (PED), or vehicle-mounted electronic devices (such as, driving assistance systems diver information system, global positioning system (GPS), and audio-visual entertainment systems), display apparatuses have become one of the indispensable key components of the electronic products.

Typical display apparatuses generally display images with a fixed brightness range, and cannot automatically adjust the color temperature of the image itself. Although the human eye has the function of automatically adjusting the color temperature, but in actual operation, the image displayed by the display apparatus may be mixed with the external ambient light to affecting the human eye's ability to perceive color, thus to result in visual differences of the user.

In particular, since the color temperature value of the ambient light can be different at different times of the day, thus the problem may get worse when the ambient light at different times is projected into the display, the user's eyes is more likely to adjust the color temperature incorrectly and not perceive the color precisely. How to enable users to precisely perceive the color displayed by the display apparatus without being affected by external environmental light has become an important issue for those skilled in the art.

Therefore, there is a need to provide an advanced an image adjusting method of a display apparatus and applications thereof to overcome the drawbacks of the prior art.

SUMMARY OF THE DISCLOSURE

One embodiment of the present disclosure is to provide an image adjusting method of a display apparatus, wherein the method includes steps as follows: A plurality of preset grayscale-brightness relationship curves are determined corresponding to a plurality of time periods of a day, respectively. A reference grayscale-brightness relationship curve is selected from the preset grayscale-brightness relationship curves according to an acquisition time of an image data, corresponding to one of the time periods. A real-time ambient light is acquired, and it is compared with at least one of a reference contrast and a reference ambient light brightness corresponding to the reference grayscale-brightness relationship curve. At least one other grayscale-brightness relationship curve is selected from the preset grayscale-brightness relationship curves according to a comparison result to at least partially replace the reference grayscale-brightness relationship curve for adjusting the image data. The adjusted image data is then displayed.

Another embodiment of the present disclosure provides a display apparatus, wherein the display apparatus includes a panel unit, a memory unit, a timer, an ambient light detection unit and a controller. The memory unit is used to store a plurality of preset grayscale-brightness relationship curves corresponding to pluralities of time periods of a day, respectively. The timer is used to obtain an acquisition time of an image data. The ambient light detection unit is used to obtain a real-time ambient light. The controller is used to select a reference grayscale-brightness relationship curve from the preset grayscale-brightness relationship curves according to the acquisition time corresponding to one of the time periods; to compare one of a reference contrast and a reference ambient light brightness corresponding to the reference grayscale-brightness relationship curve with the real-time ambient light, and to select at least one other grayscale-brightness relationship curve from the preset grayscale-brightness relationship curves according to the comparison result to at least partially replace the reference grayscale-brightness relationship curve for adjusting the image data and then providing the adjusted image data to the panel unit that is used to display the adjusted image data.

According to the above embodiments, an image adjusting method of a display apparatus and applications thereof are provided. A daily time (24 hours) is divided into a plurality of time periods, and each time period is allotted one preset grayscale-brightness relationship curve to provide reference contrast values and reference environmental brightness that are adapt to human vision. A reference grayscale-brightness relationship curve is selected from the preset grayscale-brightness relationship curves according to the time (and the period of time) when the display apparatus obtains an image data. The real-time measured value of an ambient light is compared with the reference contrasts and the reference ambient light brightness corresponding to the selected reference grayscale-brightness relationship curve. At least one other grayscale-brightness relationship curve is selected from the remaining preset grayscale-brightness relationship curves according to a comparison result to at least partially replace the reference grayscale-brightness relationship curve for adjusting the image data. The adjusted image data is then displayed. By this approach, the adverse effects on the vision of human eyes due to the real-time ambient light can be neutralized, so that the user can precisely perceive the color displayed according to the original image data.

BRIEF DESCRIPTION OF THE DRAWINGS

The above and other aspects of the disclosure will become better understood with regard to the following detailed description of the preferred but non-limiting embodiment(s). The following description is made with reference to the accompanying drawings.

DETAILED DESCRIPTION OF THE DISCLOSURE

The present disclosure provides an image adjusting method of a display apparatus and applications thereof to enable users to precisely perceive the color displayed by the display apparatus without being affected by external environmental light. The above and other aspects of the disclosure will become better understood by the following detailed description of the preferred but non-limiting embodiment(s). The following description is made with reference to the accompanying drawings:

Several embodiments of the present disclosure are disclosed below with reference to accompanying drawings. However, the structure and contents disclosed in the embodiments are for exemplary and explanatory purposes only, and the scope of protection of the present disclosure is not limited to the embodiments. It should be noted that the present disclosure does not illustrate all possible embodiments, and anyone skilled in the technology field of the disclosure will be able to make suitable modifications or changes based on the specification disclosed below to meet actual needs without breaching the spirit of the disclosure. The present disclosure is applicable to other implementations not disclosed in the present disclosure.

Figure 1A:
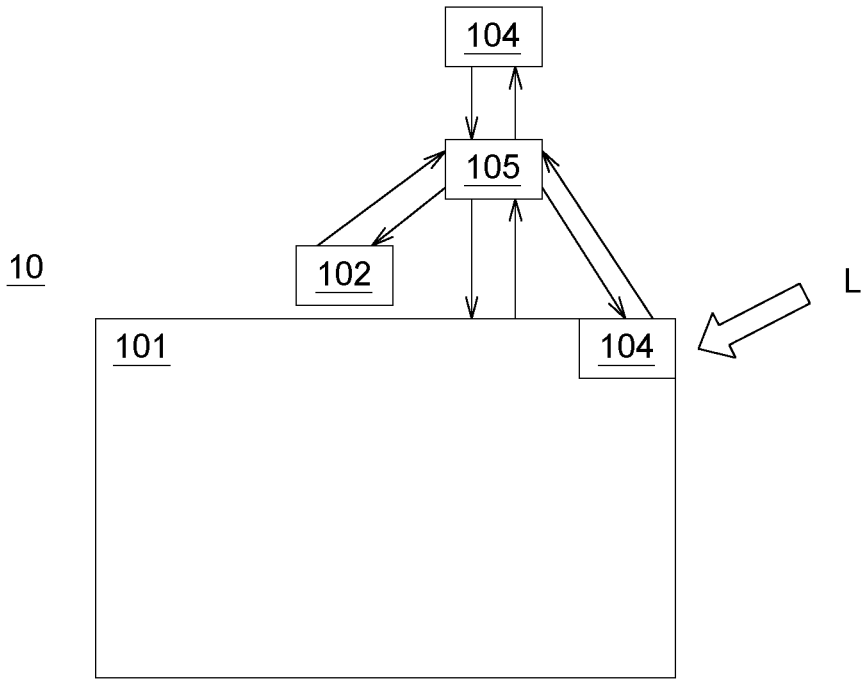
FIG. 1A is a system block diagram of a display apparatus according to an embodiment of the present disclosure.
Figure 1B:
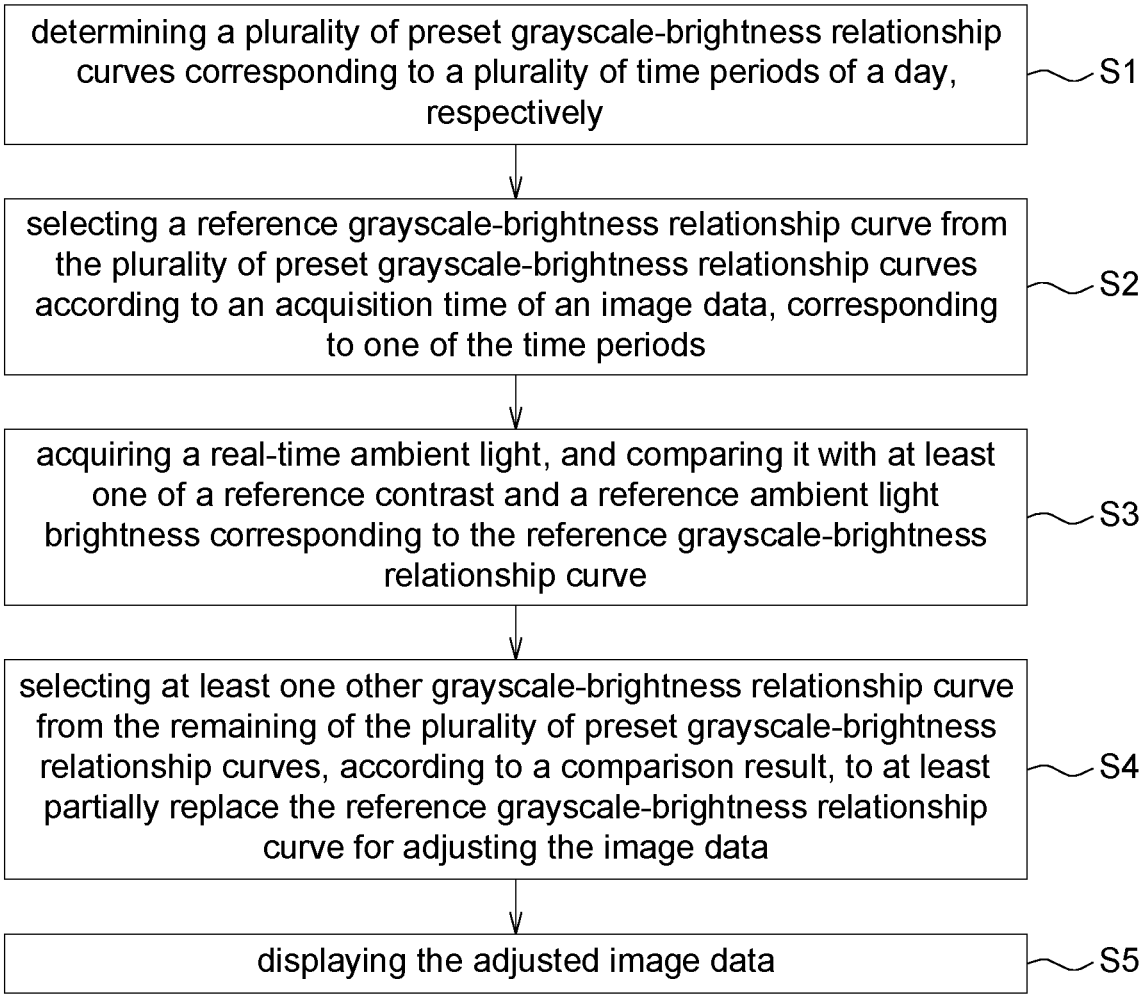
FIG. 1B is an operation flowchart illustrating the image adjustment method of a display apparatus.

FIG. 1A is a system block diagram of a display apparatus 10 according to an embodiment of the present disclosure. FIG. 1B is an operation flowchart illustrating the image adjustment method of the display apparatus 10. The display apparatus 10 includes a panel unit 101, a memory unit 102, a timer 103, an ambient light detection unit 104 and a controller 105.

In some embodiments of the present disclosure, the display apparatus 10 can be (but not limited to) a display panel built in a portable electronic device (such as smart phones, tablet computers, notebook computers, personal digital assistants, etc.) or a car electronic device (such as driver assistance systems, global positioning systems, audio-visual entertainment systems), an aircraft built-in display panel; or a fixed or movable indoor or outdoor large signage display panel. The panel unit 101 may be (but not limited to) one of a liquid crystal display panel (LCD), an electronic paper display panel (EPD), or an electronic ink (E-Ink) display panel used to display images in response to the image data provided by the controller 105.

In some embodiments of the present disclosure, the controller 105 may include (but is not limited to) a programmable central processing unit (CPU) built in the display apparatus 10 and electrically connected to the memory unit 102, the timer 103 and the ambient light detection unit 104 respectively. The controller 105 can also be (but is not limited to) one of the general purpose computer processors in any form used in industrial equipment, for example, a programmable logic controller (PLC), for controlling various components in the display apparatus 10.

The timer 103 is connected to the controller 105 and the storage unit 102, and includes clock circuits, which is used to obtain the time data at which the controller 105 acquires the original image data. The ambient light detection unit 104 includes (but is not limited to) at least one photoelectric conversion element, such as a photodiode, a charge-coupled device (CCD) or an intensified enhanced charge-coupled device (ICCD), used to obtain brightness, wavelength and other optical data of a real-time ambient light.

The memory unit 102 is built in the display apparatus 10 and is electrically connected to the controller 105, the timer 103, and the ambient light detection unit 104, respectively, for storing the time data and/or optical data sensed or acquired by the timer 103 and the ambient light detection unit 104, and used to store preset parameters, commands, original image data or image data adjusted by the controller 105 of the display apparatus 10. In some embodiments of the present disclosure, the memory unit 102 may be a computer-readable storage media, which may include (but is not limited to): (i) non-writable storage of permanent data (for example, read-only memory components built into computers, such as read-only memory discs, flash memory, and read-only memory chips that can be read by a disk driver (CD-ROM)) or any type of solid-state non-volatile semiconductor memory; (ii) a writable storage medium that stores variable data, such as a floppy disk driver, hard disk driver or any type of solid-state random-access semiconductor memory.

The image adjusting method of the display apparatus 10 includes steps as follows: First, a plurality of preset grayscale-brightness relationship curves are determined corresponding to a plurality of time periods of a day, respectively (see step S1 as shown in FIG. 1A). In some embodiments of the present disclosure, a daily time (24 hours) can be divided into a plurality of time periods according to the color temperature of the external ambient light, the user's habits, or other factors that may affect the user's visual perception in each of them.

For example, in the present embodiment, general ambient light information at different times of a day can be obtained according to the accumulated historical data of long-term observation; and a daily 24 hours can be divided into 8 am to 4 pm (8:00 am~4:00 pm), 4 pm to 6 pm (4:00 pm~6:00 pm), 6 pm to 8 pm (6:00 pm~8:00 pm), 8 pm to 11 pm (8:00 pm~11:00 pm) and 11 pm to 8 am (11:00 pm~8:00 am) 5 time periods according to the influence of the general ambient light on the color temperature change of the panel unit 101.

As shown in Table 1, according to the human eye's ability to perceive colors, a reference ambient light brightness (unit: lux), the best (better) reference contrast value (%) of the panel unit 101 that are most (more) suitable for human eyes can be preset. One grayscale-brightness relationship curve, such as BI1, BI2, BI3, BI4 or BI5, can be allocated for each time period, that can achieve the above-mentioned best reference contrast value (%) under the reference ambient light brightness, so that the user can precisely perceive the color displayed by the panel unit 101 of the display apparatus 10. And these preset data are stored in the memory unit 102.

TABLE 1

| time periods | reference contrast value (%) | grayscale L0 (black point) | grayscale L255 (white point) | grayscale-brightness relationship curve | reference ambient light brightness (Lux) |
|---|---|---|---|---|---|
| 8:00am~4:00pm | 100% | 0.3 | 300 | B1 | 250 |
| 4:00pm~6:00pm | 85% | 0.29 | 250 | B2 | 200 |
| 6:00pm~8:00pm | 75% | 0.26 | 200 | B3 | 150 |
| 8:00pm~11:00pm | 65% | 0.23 | 150 | B4 | 50 |
| 11:00pm~8:00am | 55% | 0.18 | 100 | BI5 | 20 |

For example, in the present embodiment, the brightness at the black point (grayscale value 0) of the preset grayscale-brightness relationship curve B1 is 0.3; the brightness at the white point (grayscale value 255) of the preset grayscale-brightness relationship curve B1 is 300; the best reference contrast value of is 100%; and the best reference ambient light brightness is 250. The brightness at the black point (grayscale value 0) of the preset grayscale-brightness relationship curve B2 is 0.29; the brightness at the white point (grayscale value 255) of the preset grayscale-brightness relationship curve B2 is 250; the best reference contrast value is 85%; and the best reference ambient light brightness is 200. The brightness at the black point (grayscale value 0) of the preset grayscale-brightness relationship curve B3 is 0.26; the brightness at the white point (grayscale value 255) of the preset grayscale-brightness relationship curve B3 is 200; the best reference contrast value is 75%; and the best reference ambient light brightness is 150. The brightness at the black point (grayscale value 0) of the preset grayscale-brightness relationship curve B4 is 0.23; the brightness at the white point (grayscale value 255) of the preset grayscale-brightness relationship curve B4 is 150; the best reference contrast value is 65%; and the best reference ambient light brightness is 50. The brightness at the black point (grayscale value 0) of the preset grayscale-brightness relationship curve B5 is 0.18; the brightness at the white point (grayscale value 255) of the preset grayscale-brightness relationship curve B5 is 100; the best reference contrast value is 55%; and the best reference ambient light brightness is 20.

Figure 2:
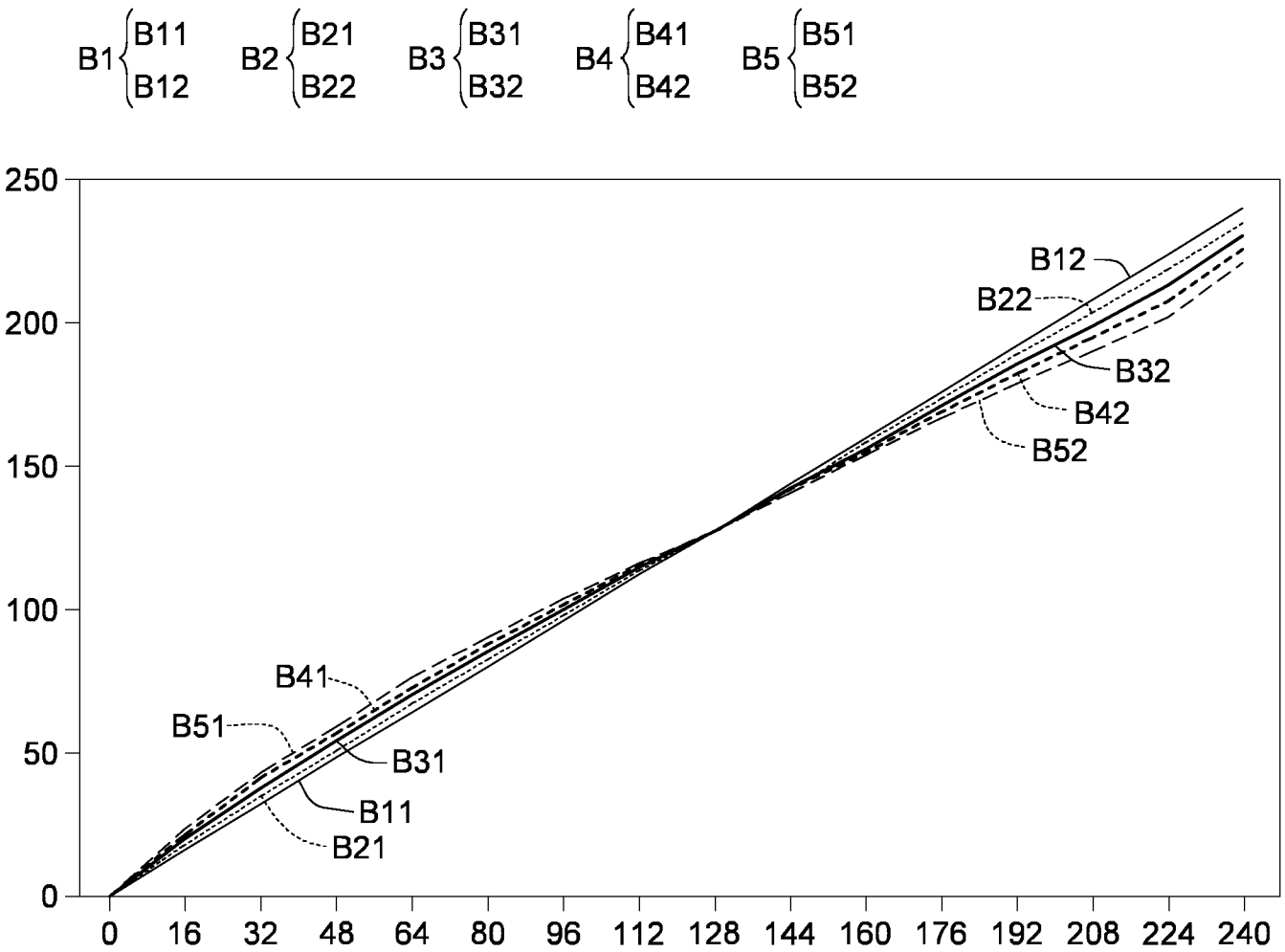
FIG. 2 is a graph showing a plurality of preset grayscale-brightness relationship curves corresponding to different time periods according to an embodiment of the present disclosure.

FIG. 2 is a graph showing a plurality of preset grayscale-brightness relationship curves corresponding to different time periods according to an embodiment of the present disclosure. Among them, each preset grayscale-brightness relationship curve B1, B2, B3, B4, or B5 can be divided into at least the first interval curve (B11, B21, B31, B411 or B51) and the second interval curve (B12, B22, B32, B412 or B52); wherein the grayscale value of the first interval curve (grayscale value ranging from 0 to 128) is greater than the grayscale value of the second interval curve (grayscale value ranging from 128 to 255).

A reference grayscale-brightness relationship curve is then selected from the plurality of preset grayscale-brightness relationship curves according to an acquisition time of an image data, corresponding to one of the time periods (see step S2 as shown in FIG. 1A). For example, in some embodiments of the present disclosure, when the original image data is transmitted to the controller 105, the time obtained by the clock circuits of the timer 103 is 9:30 in the morning, and the corresponding time period is from 8 am to 4 pm (8:00 am~4:00 pm). The preset grayscale-brightness relationship curve B1 can be correspondingly selected from the preset grayscale-brightness relationship curves B1, B2, B3, B4, and B5 as the reference grayscale-brightness relationship curve (hereinafter referred to as the reference grayscale-brightness relationship curve B1).

While the original image data is received, the ambient light detection unit 104 detects a real-time ambient light L to obtain the real-time ambient light data thereof; it is then sent to the controller 105, and is compared with at least one of the reference contrasts (for example, 100%) and the reference ambient light brightness (250) corresponding to the reference grayscale-brightness relationship curve B1 (as shown in step S3 as shown in FIG. 1A).

Thereinafter, at least one other grayscale-brightness relationship curve (rather than the reference grayscale-brightness relationship curve B1) is selected from the remaining preset gray scale-brightness relationship curves B2, B3, B4, and B5 by the controller 105, according to the comparison result; and to at least partially replace the reference grayscale-brightness relationship curve B1 for adjusting the image data (see the step S4 as shown in FIG. 1A).

In some embodiments of the present disclosure, it is mainly to compare the actual brightness value of the real-time ambient light L with the reference ambient light brightness corresponding to the reference grayscale-brightness relationship curve B1 to determine which preset grayscale-brightness relationship curve B2, B3, B4 or B5 to be chosen to serve as said other grayscale-brightness relationship curves and to at least partially replace the reference grayscale-brightness relationship curve B1.

For example, in the present embodiment, the reference ambient light brightness corresponding to the reference grayscale-brightness relationship curve B1 is 250, and the brightness of the real-time ambient light L detected by the ambient light detection unit 104 is 150, which is smaller than the reference ambient light brightness. Among the other preset grayscale-brightness relationship curves B2, B3, B4, and B5 listed in Table 1, the reference ambient light brightness of the preset grayscale-brightness relationship curve B3 is 150, which is closest to the brightness of the real-time ambient light L. Therefore, the preset grayscale-brightness relationship curve B3 can be selected to serve as said other grayscale-brightness relationship curve (hereinafter referred to as said other grayscale-brightness relationship curve B3) to completely or partially replace the reference grayscale-brightness relationship curve B1.

Figure 3A:
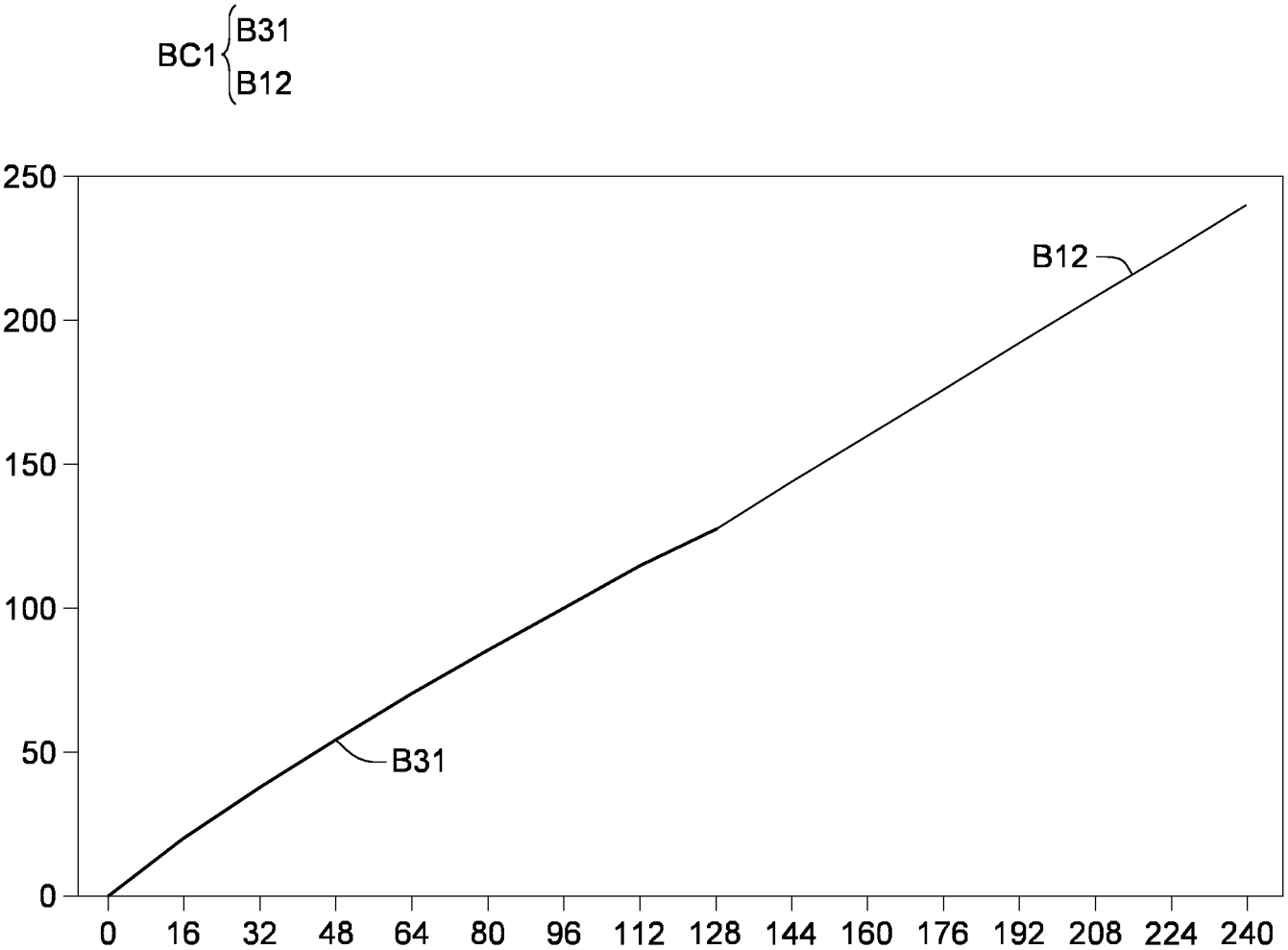
FIG. 3A is an adjusted grayscale-brightness relationship curve according to an embodiment of the present disclosure.
Figure 3B:
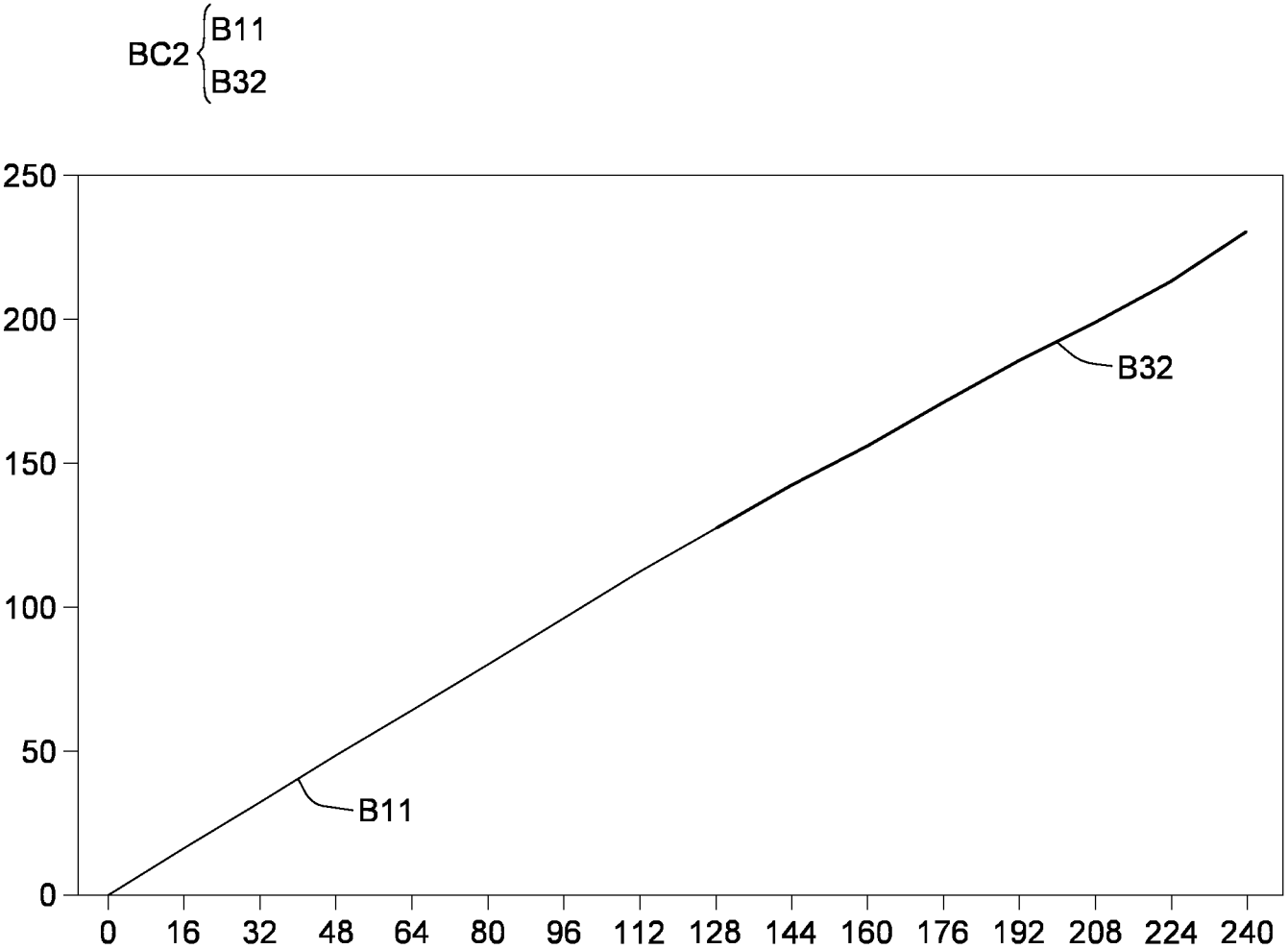
FIG. 3B is an adjusted grayscale-brightness relationship curve according to another embodiment of the present disclosure.

The method of using said other preset grayscale-brightness relationship curve B3 to replace the reference grayscale-brightness relationship curve B1 includes the following schemes: For example, a first interval curve B31 of said other preset grayscale-brightness relationship curve B3 can be selected to replaces a first interval curve B11 of the reference grayscale-brightness relationship curve B1 to form an adjusted grayscale-brightness relationship correction curve BC1 composed of the first interval curve B31 and the second interval curve B12 (as shown in FIG. 3A). Alternatively, the second interval curve B32 of said other preset grayscale-brightness relationship curve B3 can be selected to replace the second interval curve B12 of the reference grayscale-brightness relationship curve B1 to form an adjusted grayscale-brightness relationship correction curve BC2 formed by the first interval curve B11 and the second interval curve B32 (as shown in FIG. 3B). Or, replace the reference grayscale-brightness relationship curve B1 with said other grayscale-brightness relationship curve B3 thoroughly.

Because the grayscale value of the first interval curve B31 in said other grayscale-brightness relationship curve B3 is greater than the grayscale value of the first interval curve B11 in the reference grayscale-brightness relationship curve B1; The gray scale value of the second interval curve B32 in said other grayscale-brightness relationship curve B3 is smaller than the gray scale value of the second interval curve B12 in the reference grayscale-brightness relationship curve B1. Therefore, when the actual brightness value of the real-time ambient light L (the actual value is 150) is less than the reference ambient light brightness (250), it prefers to use the grayscale value of the second interval curve B32 in said other grayscale-brightness relationship curve B3 to replace the second curve B12 in the reference grayscale-brightness relationship curve B1 (as shown in FIG. 3B), to make the adjusted grayscale-brightness relationship correction curve BC2 match with the real-time ambient light L, thereby neutralizing the adverse effect of the real-time ambient light L to allow the user to precisely perceive the color displayed according to the original image data.

In another embodiment, when the original image data is transmitted to the controller 105, the time obtained by the clock circuit of the timer 103 is 6:30 pm, the corresponding time period is 6 pm to 8 pm (6:00 pm~8:00 pm). Therefore, the corresponding preset grayscale-brightness relationship curve B3 can be selected from the preset grayscale-brightness relationship curves B1, B2, B3, B4, and B5 to serve as the reference grayscale-brightness relationship curve (hereinafter referred to as the reference grayscale-brightness relationship curve B3).

Wherein, the reference ambient light brightness corresponding to the reference grayscale-brightness relationship curve B3 is 150. The actual measured value of the real-time ambient light L brightness detected by the ambient light detecting unit 104 is 175, which is greater than the reference ambient light brightness of 150. Among the other preset grayscale-brightness relationship curves B1, B2, B4, and B5 listed in Table 1, the reference ambient light brightness of the preset grayscale-brightness relationship curve B2 is 200, which is closest to the brightness of the real-time ambient light L (175). Therefore, the preset grayscale-brightness relationship curve B2 can be selected to serve as said other grayscale-brightness relationship curve (hereinafter referred to as said other grayscale-brightness relationship curves B2) to completely or partially replace the reference grayscale-brightness relationship curve B3.

The method of using said other preset grayscale-brightness relationship curve B2 to replace the reference grayscale-brightness relationship curve B3 includes the following schemes: For example, a first interval curve B21 of said other preset grayscale-brightness relationship curve B2 can be selected to replaces a first interval curve B31 of the reference grayscale-brightness relationship curve B3 to form an adjusted grayscale-brightness relationship correction curve BC3 composed of the first interval curve B21 and the second interval curve B32 (as shown in FIG. 3B). Alternatively, the second interval curve B22 of said other preset grayscale-brightness relationship curve B2 can be selected to replace the second interval curve B32 of the reference grayscale-brightness relationship curve B3 to form an adjusted grayscale-brightness relationship correction curve BC4 formed by the first interval curve B21 and the second interval curve B32 (as shown in FIG. 3B). Or, replace the reference grayscale-brightness relationship curve B2 with said other grayscale-brightness relationship curve B3 thoroughly.

Figure 4A:
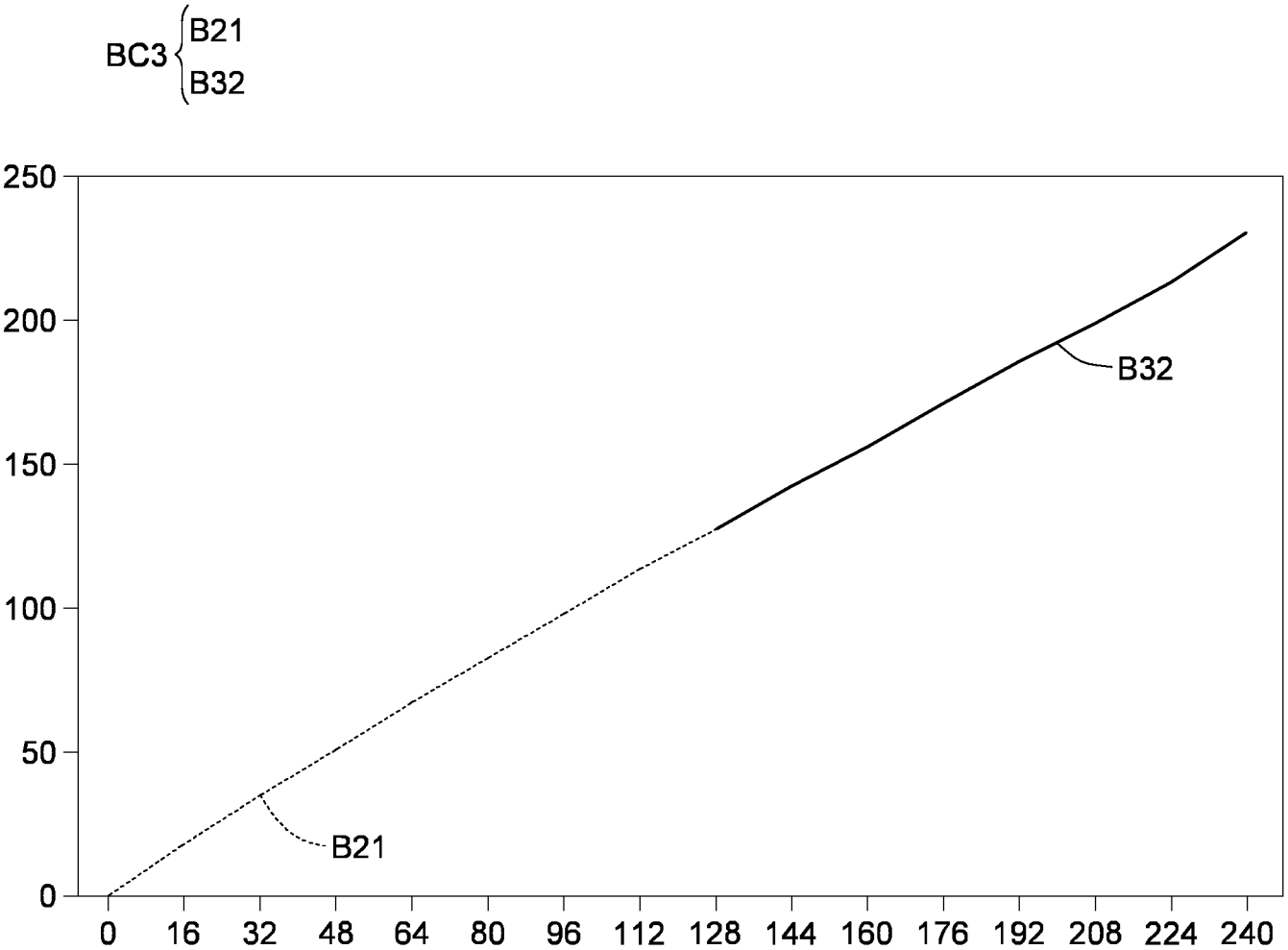
FIG. 4A is an adjusted grayscale-brightness relationship curve according to yet another embodiment of the present disclosure.
Figure 4B:
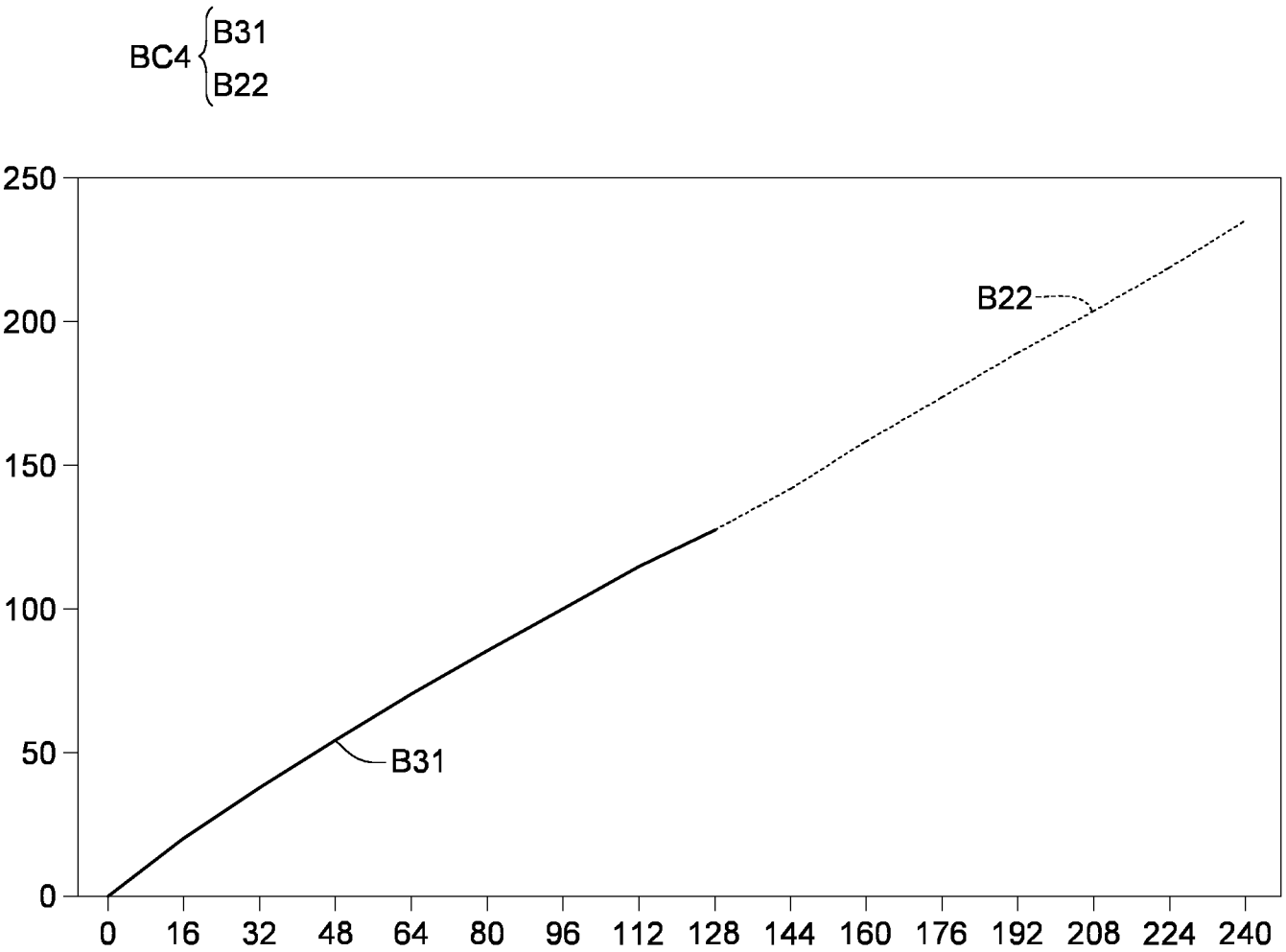
FIG. 4B is an adjusted grayscale-brightness relationship curve according to still yet another embodiment of the present disclosure.

Because the grayscale value of the first interval curve B21 in said other grayscale-brightness relationship curve B2 is smaller than the grayscale value of the first interval curve B31 in the reference grayscale-brightness relationship curve B3; The gray scale value of the second interval curve B22 in said other grayscale-brightness relationship curve B2 is greater than the gray scale value of the second interval curve B32 in the reference grayscale-brightness relationship curve B3. Therefore, when the actual brightness value of the real-time ambient light L (the actual value is 175) is greater than the reference ambient light brightness (150), it prefers to use the second interval curve B22 in said other grayscale-brightness relationship curve B2 to replace the second curve B32 in the reference grayscale-brightness relationship curve B3 (as shown in FIG. 4B), to make the adjusted grayscale-brightness relationship correction curve BC4 match with the real-time ambient light L, thereby neutralizing the adverse effect of the real-time ambient light L to allow the user to precisely perceive the color displayed according to the original image data.

However, the correction and replacement method of the reference grayscale-brightness relationship curve B3 is not limited to this regard. For example, in some embodiments of the present disclosure, when the actual brightness of the real-time ambient light L is not much different from the reference ambient light brightness, the first interval curve B12 in said other grayscale-brightness relationship curve B2 can be selected to replace the first interval curve B31 in the reference gray scale-brightness relationship curve B3 (as shown in FIG. 4A) based on the consideration of image contrast.

Subsequently, the adjusted image data can be provided to the panel unit 101 by the controller 105 to display the corresponding image (as shown in step S5 in FIG. 1A).

According to the above embodiments, an image adjusting method of a display apparatus and applications thereof are provided. A daily time (24 hours) is divided into a plurality of time periods, and each time period is allotted one preset grayscale-brightness relationship curve to provide reference contrast values and reference environmental brightness that are adapt to human vision. A reference grayscale-brightness relationship curve is selected from the preset grayscale-brightness relationship curves according to the time (and the period of time) when the display apparatus obtains an image data. The real-time measured value of an ambient light is compared with the reference contrasts and the reference ambient light brightness corresponding to the selected reference grayscale-brightness relationship curve. At least one other grayscale-brightness relationship curve is selected from the remaining preset grayscale-brightness relationship curves according to a comparison result to at least partially replace the reference grayscale-brightness relationship curve for adjusting the image data. The adjusted image data is then displayed. By this approach, the adverse effects on the vision of human eyes due to the real-time ambient light can be neutralized, so that the user can precisely perceive the color displayed according to the original image data.

While the invention has been described by way of example and in terms of the preferred embodiment (s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An image adjusting method of a display apparatus, comprises:

determining a plurality of preset grayscale-brightness relationship curves corresponding to a plurality of time periods of a day, respectively;

selecting a reference grayscale-brightness relationship curve from the plurality of preset grayscale-brightness relationship curves according to an acquisition time of an image data, corresponding to one of the time periods;

acquiring a real-time ambient light, and comparing it with at least one of a reference contrast and a reference ambient light brightness corresponding to the reference grayscale-brightness relationship curve;

selecting at least one other grayscale-brightness relationship curve from the remaining of the plurality of preset grayscale-brightness relationship curves, according to a comparison result, to at least partially replace the reference grayscale-brightness relationship curve for adjusting the image data; and displaying the adjusted image data.

2. The image adjusting method according to claim 1, wherein the step of adjusting the image data comprises:

dividing the reference grayscale-brightness relationship curve into at least a first interval curve and a second interval curve, wherein a grayscale value of the first interval curve is greater than that of the second interval curve;

dividing the at least one other preset grayscale-brightness relationship curve into at least a third interval curve and a fourth interval curve, respectively corresponding to the first interval curve and the second interval curve; and replacing the first interval curve with the third interval curve, or replacing the second interval curve with the fourth interval curve, or replacing the reference grayscale-brightness relationship curve with the at least one other grayscale-brightness relationship curve.

3. The image adjusting method according to claim 2, wherein when a brightness of the real-time ambient light is greater than the reference ambient light brightness, a grayscale value of the third interval curve is less than that of the first interval curve, and a grayscale value of the fourth interval curve is greater than that of the second interval curve.

4. The image adjusting method according to claim 2, wherein when a brightness of the real-time ambient light is less than the reference ambient light brightness, a grayscale value of the third interval curve is greater than that of the first interval curve, and a grayscale value of the fourth interval curve is less than that of the second interval curve.

5. The image adjusting method according to claim 1, wherein the step of determining the plurality of preset grayscale-brightness relationship curves comprises presetting a reference grayscale-brightness relationship of the display apparatus corresponding to each of the time periods according to human eye's ability to perceive colors.

6. The image adjusting method according to claim 1, wherein the adjusted image data is displayed by a liquid crystal display panel (LCD), an electronic paper display panel (EPD), or an electronic ink (E-Ink) display panel.

7. The image adjusting method according to claim 1, wherein the step of acquiring the real-time ambient light comprises using a charge-coupled device (CCD) or an intensified enhanced charge-coupled device (ICCD) to detect brightness and wavelength of the real-time ambient light.

8. The image adjusting method according to claim 1, wherein the reference grayscale-brightness relationship curve selected from the plurality of preset grayscale-brightness relationship curves is stored in a memory unit built in the display apparatus.

9. The image adjusting method according to claim 8, wherein the memory unit is selected from a group consisting of a non-writable storage of permanent data a writable storage medium that stores variable data and a combination thereof.

10. A display apparatus, comprising:

a memory unit, used to store a plurality of preset grayscale-brightness relationship curves corresponding to pluralities of time periods of a day, respectively;

a timer, used to obtain an acquisition time of an image data;

an ambient light detection unit, used to obtain a real-time ambient light;

a controller, used to select a reference grayscale-brightness relationship curve from the preset grayscale-brightness relationship curves according to the acquisition time corresponding to one of the time periods; to compare one of a reference contrast and a reference ambient light brightness corresponding to the reference grayscale-brightness relationship curve with the real-time ambient light, and to select at least one other grayscale-brightness relationship curve from the preset grayscale-brightness relationship curves according to the comparison result to at least partially replace the reference grayscale-brightness relationship curve for adjusting the image data; and a panel unit, used to display the image data adjusted by and provided from the controller.

11. The display apparatus according to claim 10, wherein the step of adjusting the image data performed by the controller comprises:

dividing the reference grayscale-brightness relationship curve into at least a first interval curve and a second interval curve, wherein a grayscale value of the first interval curve is greater than that of the second interval curve;

dividing the at least one other preset grayscale-brightness relationship curve into at least a third interval curve and a fourth interval curve, respectively corresponding to the first interval curve and the second interval curve; and replacing the first interval curve with the third interval curve, or replacing the second interval curve with the fourth interval curve, or replacing the reference grayscale-brightness relationship curve with the at least one other grayscale-brightness relationship curve.

12. The display apparatus according to claim 11, wherein when a brightness of the real-time ambient light is greater than the reference ambient light brightness, a grayscale value of the third interval curve is less than that of the first interval curve, and a grayscale value of the fourth interval curve is greater than that of the second interval curve.

13. The display apparatus according to claim 11, wherein when a brightness of the real-time ambient light is less than the reference ambient light brightness, a grayscale value of the third interval curve is greater than that of the first interval curve, and a grayscale value of the fourth interval curve is less than that of the second interval curve.

14. The display apparatus according to claim 10, wherein the panel unit is a liquid crystal display panel (LCD), an electronic paper display panel (EPD), or an electronic ink (E-Ink) display panel.

15. The display apparatus according to claim 10, wherein the ambient light detection unit comprises a charge-coupled device (CCD) or an intensified enhanced charge-coupled device (ICCD).

16. The display apparatus according to claim 10, wherein the memory unit is selected from a group consisting of a non-writable storage of permanent data a writable storage medium that stores variable data and a combination thereof.

17. The display apparatus according to claim 10, wherein each of the plurality of preset grayscale-brightness relationship curves comprises a reference grayscale-brightness relationship of the display apparatus corresponding to each of the time periods according to human eye's ability to perceive colors.

18. The display apparatus according to claim 10, wherein the controller comprises a programmable central processing unit (CPU) built in the display apparatus and electrically connected to the memory unit, the timer and the ambient light detection unit respectively.

* * * * *